United States Patent [19]

Andersson et al.

[11] 4,068,727

[45] Jan. 17, 1978

[54] METHOD AND DEVICE FOR DAMPING THE RECOIL OF A WORK TOOL CONNECTED TO A ROCK DRILLING MACHINE

[75] Inventors: Kurt Holger Andersson, Tyreso; Carl Gösta Bernhard Ekwall, Saltsjobaden; Bo Erik Forsberg, Vallingby, all of Sweden

[73] Assignee: Atlas Copco Aktiebolag, Nacka, Sweden

[21] Appl. No.: 665,630

[22] Filed: Mar. 10, 1976

[30] Foreign Application Priority Data

Mar. 18, 1975 Sweden ..... 75030387

[51] Int. Cl.[2] ..... B25D 9/00

[52] U.S. Cl. ..... 173/1; 173/139; 92/85 B

[58] Field of Search ..... 173/1, 139, 134; 92/85 B, 143

[56] References Cited

U.S. PATENT DOCUMENTS

| | | | |
|---|---|---|---|
| 3,168,324 | 2/1965 | Kennell | 173/139 |
| 3,266,581 | 8/1966 | Cooley et al. | 173/139 |
| 3,451,492 | 6/1969 | Ekstrom et al. | 173/139 |
| 3,741,072 | 6/1973 | Romell et al. | 91/290 |
| 3,831,500 | 8/1974 | Kitamura et al. | 92/85 B |
| 3,866,690 | 2/1975 | Lance et al. | 173/15 |

*Primary Examiner*—Robert A. Hafer
*Attorney, Agent, or Firm*—Flynn & Frishauf

[57] ABSTRACT

A recoil damping device for a percussive tool comprises a retard piston which is movable in a cushioning chamber. The feeding force and/or the pressure in the supply passage to the cushioning chamber is regulated so that the retard piston is axially free relative to the machine housing.

27 Claims, 3 Drawing Figures

METHOD AND DEVICE FOR DAMPING THE RECOIL OF A WORK TOOL CONNECTED TO A ROCK DRILLING MACHINE

The present invention relates to percussive tools for rock drilling, chiselling, breaking or the like and concerns a device and a method for damping the recoil of a work tool. More specifically it is intended by the invention to damp the recoil in a percussive tool of the kind that comprises a machine housing and a linearly reciprocating hammer piston therein.

In conventional percussive tools of this type, the recoil is damped by means of a helical spring or Belleville-type springs. Such springs are susceptible to large amplitudes. This means that a large feeding force has to be applied to the percussive tool in order to achieve an efficient recoil damping. In rig-mounted designs, the large feeding force on its part means that the feed bar and drill booms intended for carrying the percussive tool must be made heavy.

It has been suggested in handheld rock drilling machines to provide an air cushion for preventing shocks from being transmitted from the tool when it rebounds from the working surface to the handle and the hand of the operator. In this construction the tool chuck can slide backwards into the machine a short distance when the tool and its collar rebounds. This movement is retarded against an air cushion which is diposed between a forward end surface on the machine housing and a flange on the movable cylinder bottom of the machine housing. After every rebound this flange is urged against a surface on the front head of the machine. This position, thus, defines the point where the hammer piston hits the tool.

OBJECTS OF THE INVENTION

It is an object of the invention to obtain a device for damping the recoil from a work tool which is insusceptible to large amplitudes, thereby making it possible to considerably reduce the feeding force applied to the percussive tool when compared with the feeding force where conventional steel springs are used.

Another object of the invention is to obtain a recoil damping device which provides a floating impact position between the work tool and the hammer piston.

A further object of the invention is to obtain a recoil damping device which provides a thrust bearing for the rotation chuck bushing of the work tool.

A still further object of the invention is to obtain a construction which is cheaper and more reliable than those comprising steel springs and conventional thrust bearings.

The above and other purposes of the invention will become apparent from the description following hereinafter with reference to the accompanying drawings in which one embodiment of the invention is shown by way of example. It is to be understood that this embodiment is only illustrative of the invention and that various modifications thereof may be made within the scope of the claims following hereinafter.

DETAILED DESCRIPTION

Figure 1:
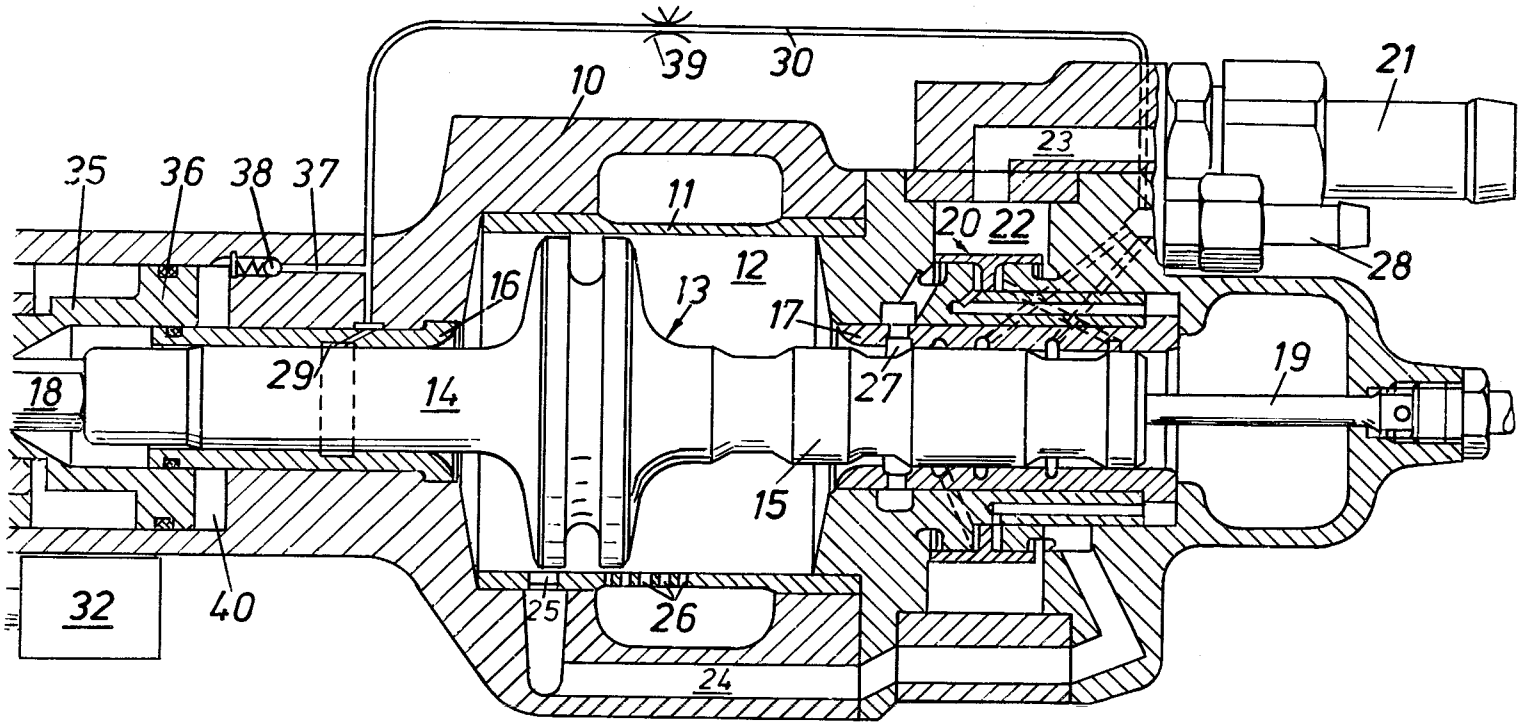
FIG. 1 is a longitudinal section through the back part of a rock drilling machine according to the invention.

In FIG. 1, the housing of a rock drilling machine is depicted by 10. A lining 11 is inserted in the housing to form a drive chamber 12 for a reciprocable hammer piston 13. The hammer piston comprises piston rods 14, 15 which extend out of the drive chamber 12 in both senses, i.e. at both sides from the enlarged drive head of the piston 13. The piston 13 is guided in the housing 10 by means of its piston rods 14, 15 which cooperate with guiding portions that are arranged in the housing 10 in the form of bushings 16, 17, in front of and at the rear of the drive chamber 12 respectively, as seen in the direction of impact of the piston 13. It is characteristic for the guiding of the hammer piston 13 that the guiding is completely carried out by the bushings 16, 17 whereas the enlarged drive head of the piston 13 has no direct contact with the lining 11. This is accomplished by the play between the bushings 16, 17 and the piston rods 14, 15 being smaller than the play between the head of the piston 13 and the lining 11.

At its forward end, the hammer piston 13 is arranged to strike the shank of a tool 18 that is inserted in the forward portion of the housing 10. A flushing tube 19 for the supply of flushing fluid to the tool 18 is fastened in the rear part of the housing 10 and extends in conventional manner through the hammer piston 13.

An annular, axially displaceable air distributing valve 20 of the seat valve type is disposed in the housing 10. Its object is to distribute compressed air to the front and rear parts of the drive chamber 12 in such a way that the hammer piston 13 is forced to reciprocate. To this end, the valve 20 is in communication with a fitting 21 so that it can be supplied with oil free compressed air via an annular chamber 22 and a passage 23.

In one of its two positions, the position that is shown in FIG. 1, the valve 20 permits compressed air to pass from the annular chamber 22 to the front part of the drive chamber 12 so that the hammer piston 13 is forced rearwardly in a return stroke. After passing the valve 20 the compressed air passes through a passage 24 and one or more inlet openings 25 in the lining 11 of the drive chamber. The lining 11 is also provided with a plurality of outlet openings 26.

In its other position, the valve 20 permits compressed air to pass from the annular chamber 22 to the rear part of the drive chamber 12 for forcing the hammer piston 13 forwardly during the work stroke. In this valve position, the annular chamber 22 is in communication with an annular groove 27 in the rear bushing 17. This annular groove 27 is located at a distance from the front end of the bushing 17 and it can therefore be closed off from the drive chamber 12 by the piston rod 15.

The compressed air for driving the hammer piston is thus free from oil whereas a separate lubricating system is arranged to supply a lubricant to the portions in the housing 10 that guide the piston rods 14, 15; namely the bushings 16, 17. A fitting for supply of oil-carrying compressed air is depicted by 28. In the impact motor shown in the Figures, the lubricating system comprises means to supply oil-carrying compressed air to the bushings 16, 17. In this impact motor, the oil-carrying compressed air is utilized also in the servo circuit that is intended to shift the position of the distributing valve 20. By this arrangement, the valve will also be lubricated. The volume of the oil-carrying compressed air is only a minor portion of the air volume totally consumed by the impact motor. Moreover, the oil that is supplied as a mist is deposited in the impact motor and is transformed almost completely into non-mist form.

To accomplish the lubrication of the forward guide bushing 16, this bushing is provided with an annular groove 29 that communicates with a lubricating air passage 30 in the housing 10. For the sake of clarity, this lubricating air passage 30 is shown outside the housing. The passage 30 is directly connected to the fitting 28.

The tool 18 is caused to rotate by means of a rotation chuck bushing or sleeve member 31, in which the shank of the tool is displaceably and non-turnably guided. The sleeve or bushing 31 is rotated by means of a motor 32 over a gear 33, 34. The bushing 31 is guided non-turnably and axially movably in a sleeve or rotation chuck 34 and has a rearwardly extending cylindrical portion 35. The sleeve 34 is journalled in the housing 10 by means of taper roller bearings 41, 42. The cylindrical portion 35 continues as an annular piston 36. The annular piston 35 closes off a retard or cushioning chamber 40. The retard chamber 40 is in communication with the passage 30 through a passage 37. A check valve 38 is inserted in the passage 37. The pressure in the retard chamber 40 is regulated by means of a redusing valve 39.

With reference to the Figures, the operation of the rock drilling machine will be described.

Figure 2:
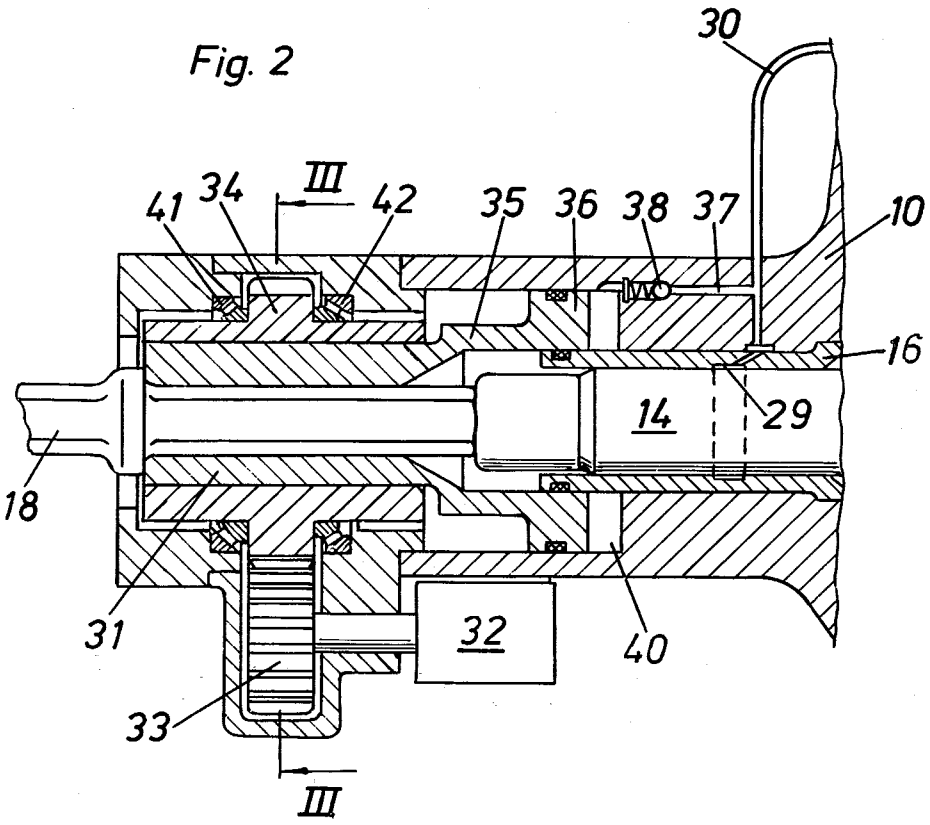
FIG. 2 is a longitudinal section through the front part of the rock drilling machine.
Figure 3:
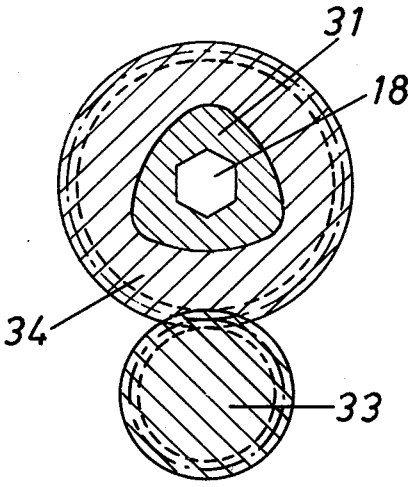
FIG. 3 is a section on the line III—III in FIG. 2.

In FIGS. 1 and 2, the hammer piston 13 is shown in the position where it hits the tool 18. The mode of operation of the impact motor is described in detail in the Swedish patent application No. 7402347-4. By a suitable choice of the pressure in the passage 30 the air cushion is prestressed to a force which is considerably less than the feeding force applied to the rock drilling machine. Assume the feeding force to be applied without starting the impact motor. This means that the air spring is contracted until its pressure corresponds to the feeding force. When the impact motor is started, the resultant recoil force causes the air spring to extend, whereupon the penetration into the rock continues. In this case, thus, the machine will operate during the first seconds with a too far rearwardly located impact position. The resultant recoil force is depnedent on the impact position, which is stabilized where the recoil force is equal to the feeding force minus the spring force. It is to be understood that impact position means the position of the tool 18 where the hammer piston 13 hits the shank of the tool 18. It is further to be understood that resultant recoil force means the resultant force which the housing 10 is subjected to during operation of the impact motor. This resultant force consists substantially of the sum of the force caused by the recoiling shock waves acting on the tool and the force caused by the pressure difference over the drive head of the piston 13. The impact position, thus, is adjusted such that the expression $$R = F - K$$

is met, where

R is the average of the resultant recoil force acting on the housing;

F is the feeding force acting on the housing; and

K is the spring force acting on the housing.

The air that leaks is compensated automatically through the check valve 38. In order to achieve the above function it is necessary to ensure that the forward movement of the rotation chuck bushing 31 and thus also the retard piston 36 is not hindered by any mechanical stop. Such a stop would deprive the air spring one of its functions, namely to urge the drill bit against the rock. If the retard piston and the rotation chuck bushing are allowed to abut a stop, such abutment will occur when the machine housing is in its average rear turning position during its oscillations. The rotation chuck bushing then moves out of contact with the drill rod, which in this moment is free. Since the impact is delivered approximately when the machine housing is in its rear turning position, the drill rod will have unsatisfactory contact with the rock in the moment when the impact is delivered.

The essence of the present invention in that a permanent contact is achieved between the collar of the tool 18 and the rotation chuck bushing 31. This demands that there is no axial contact between a surface on the rotation chuck bushing 31 and the retard piston 36 on the one hand and on the housing 10 of the rock drilling machine on the other; that means that a floating impact position is maintained.

Tests with the present invention have shown that, when compared with conventional steel spring damping devices, the same drilling rate is obtained by a feeding force which is about thirty percent lower.

Because the retard piston 36 also rotates in the retard chamber 40, the air spring besides works as a thrust bearing for the rotation chuck bushing 31.

It is also found that the noise caused by the rods becomes lower when compared with the noise where conventional steel spring damping devices are used. This is due to the improved resting which is achieved between the drill bit and the rock.

In the above, the invention is described with reference to a rock drilling machine. The floating impact position, however, may be applied in all type of percussive tools, such as breakers and chiselling machines.

What we claim is:

1. A method for damping the recoil of a work tool comprising:

applying a feeding force to a percussive tool (10), transmitting the feeding force to the work tool (18) over a retard piston member (36), said retard piston member being axially movable in a cushioning chamber, continuously supplying said cushioning chamber with pressurized fluid through a passage in the machine housing of the percussive tool, said machine housing being subjected during operation to a rearwardly acting force which includes a force caused by the recoil of the work tool, and providing a floating impact position of said retard piston member by regulating at least one of the feeding force and the pressure in said passage relative to said rearwardly acting force so that said retard piston member during operation is maintained out of axial contact with said machine housing.

2. A method according to claim 1 comprising regulating both the feeding force and the pressure in said passage.

3. A method according to claim 1 wherein said feeding force is transmitted to said work tool via a sleeve member (31) which is axially journalled in said machine housing and cushioned on the pressurized fluid in said cushioning chamber.

4. A method in a percussive rock drilling for damping the recoil of a work tool comprising:

applying a feeding force to a rock drilling machine (10), transmitting the feeding force to the work tool (18) over a retard piston member (36) and a sleeve member (31), said retard piston member being axially movable in a cushioning chamber, and said sleeve member being adapted to non-rotatably engage said work tool, supplying said cushioning chamber with pressurized fluid through a passage in the machine housing of the rock drilling machine, said machine housing being subjected during operation to a rearwardly acting force which includes a force caused by the recoil of the work tool, and providing a floating impact position of said retard piston member and sleeve member by regulating at least one of the feeding force and the pressure in said passage relative to said rearwardly acting force so that said retard piston member and said sleeve member are maintained out of axial contact with said machine housing.

5. A method according to claim 4 wherein said cushioning chamber is continuously pressurized.

6. A method according to claim 4 comprising regulating both the feeding force and the pressure in said passage.

7. A method according to claim 4 wherein said sleeve member (31) is axially journalled in said housing and cushioned on the pressurized fluid entrapped in said cushioning chamber.

8. A recoil damping device for a percussive tool such as rock drilling machines and chiselling machines which includes a work tool (18), a machine housing (10) coupled to said work tool and adapted to apply a feeding force to said work tool in a working direction, a hammer piston (13) reciprocating in the machine housing and adapted to deliver impacts to said work tool, said impacts generating shock wave reflexes in said work tool, said shock wave reflexes causing a recoil force on said machine housing, a guide member (31) adapted to guide said work tool, said recoil damping device damping said recoil force and comprising:

an annular cushioning chamber (40) in said machine housing, a passage (37) in said machine housing to admit pressure fluid into said cushioning chamber, a retard piston member (36) axially movable in said cushioning chamber, and isolating means for isolating said retard piston member from the work pressure of said hammer piston rearwardly of said guide member, said retard piston member being adapted to damp the recoil force transmitted over said guide member.

9. A device according to claim 8 comprising means for continuously connecting said passage to a source of pressure fluid so as to continuously supply pressure fluid to said cushioning chamber.

10. A device according to claim 9 comprising guide means (16) in said machine housing for internally guiding said retard piston member (36), a piston rod (14) projecting in the direction of impact from said hammer piston (13), said guide means guiding said piston rod.

11. A device according to claim 8 comprising a cylindrical member (35) arranged to interconnect said retard piston member (36) and said guide member (31), said cylindrical member (35) projecting forwardly from said retard piston member and being integral therewith.

12. A device according to claim 9 wherein the pressurized fluid in said cushioning chamber (40) provides a thrust bearing for said sleeve member (31).

13. A device according to claim 8 comprising means for radially inwardly bounding said cushioning chamber so as to isolate said cushioning chamber from said hammer piston.

14. A device according to claim 10 wherein said guide means comprises a sleeve-shaped part having an outer cylindrical guiding surface for guiding said retard piston member, said retard piston member being annular about said guiding section.

15. A device according to claim 10 wherein said sleeve-shaped part comprises a bushing (16) which is inserted in said machine housing.

16. A device according to claim 11 wherein the retard piston member (36), the cylindrical member (35) and the sleeve member (31) are an integral unit.

17. A device according to claim 8 wherein the pressurized fluid in said cushioning chamber (40) provides a thrust bearing for said sleeve member 31.

18. A method in percussive working such as rock drilling and chiselling for damping the recoil of a work tool comprising:

applying a feeding force to a percussive tool (10) in a forward direction, transmitting the feeding force to the work tool (18) over a retard piston member (36) and a sleeve-shaped guide member (31) adapted to guide said work tool, said retard piston member being arranged rearwardly of said guide member and being axially movable in a cushioning chamber, continuously supplying said cushioning chamber with pressurized fluid through a passage in the machine housing of the percussive tool, additionally applying impacts to said work tool by means of a hammer piston, said impacts generating shock wave reflexes in said work tool, said shock wave reflexes causing a recoil force on said machine housing, providing a floating impact position of said retard piston member and guide member by regulating at least one of the feeding force and the pressure in said passage relative to said recoil force so that said retard piston member and guide member instantaneously is maintained out of axial contact with said machine housing, and bounding said cushioning chamber and isolating said retard piston member from the work pressure of said hammer piston rearwardly of said guide member.

19. A method according to claim 18 wherein said guide member (31) is adapted to non-rotatably engage said work tool and is rotated and axially journalled in said housing and cushion on the pressurized fluid entrapped in said cushioning chamber.

20. A recoil damping device for a percussive tool such as rock drilling machines and chiselling machines which includes a work tool (18), a machine housing (10) coupled to said work tool and adapted to apply a feeding force to said work tool in a working direction, a hammer piston (13) reciprocating in the machine housing and adapted to deliver impacts to said work tool, said impacts generating shock wave reflexes in said work tool, said shock wave reflexes causing a recoil force on said machine housing, a guide member (31) adapted to guide said work tool, said recoil damping device damping said recoil force and comprising:

an annular cushioning chamber (40) in said machine housing, a passage (37) in said machine housing to admit pressure fluid into said cushioning chamber, a retard piston member (36) axially movable in said cushioning chamber and located rearwardly of said guide member, and a sleeve-shaped member (16) firmly attached in said machine housing and adapted to radially inwardly bound said cushioning chamber for isolating said retard piston member from the work pressure of said hammer piston rearwardly of said guide member, said retard piston member being movably guided relative to said sleeve-shaped member around the outer side thereof and being adapted to damp the recoil force transmitted over said guide member.

21. A device according to claim 20 comprising means for radially inwardly bounding said cushioning chamber so as to isolate said cushioning chamber from said hammer piston.

22. A device according to claim 20 wherein said passage is continuously connected to a pressure source.

23. A device according to claim 20 wherein said retard piston member has an inner cylindrical surface and said sleeve-shaped member is provided with an outer cylindrical surface adapted to slidably engage said inner cylindrical surface of said retard piston member.

24. A device according to claim 23 comprising a piston rod (14) projecting from said hammer piston in the direction of impact, and wherein said sleeve-shaped member is provided with an inner cylindrical guide surface adapted to guide said piston rod (14).

25. A device according to claim 24 wherein said sleeve-shaped member comprises a bushing (16) which is inserted in said machine housing.

26. A device according to claim 20 wherein said retard piston member (36) and said guide member (31) are an integral unit.

27. A device according to claim 20 comprising means for rotating said guide member (31), said guide member being adapted to non-rotatably engage said work tool, and wherein the pressurized fluid entrapped in said cushioning chamber (40) provides a thrust bearing for said guide member during the rotation thereof.

* * * * *

UNITED STATES PATENT AND TRADEMARK OFFICE

CERTIFICATE OF CORRECTION

PATENT NO. : 4,068,727

DATED : January 17, 1978

INVENTOR(S) : Kurt H. ANDERSSON, et al

It is certified that error appears in the above-identified patent and that said Letters Patent are hereby corrected as shown below:

Column 5, line 42, after "housing," begin a new paragraph with "a passage (37)...";

Column 6 (claim 14), line 9, after "guiding" change "section" to --surface--;

Column 6 (claim 19), line 53, after "housing and" change "cushion" to --cushioned--.

Signed and Sealed this

Ninth Day of May 1978

[SEAL]

Attest:

RUTH C. MASON
Attesting Officer

LUTRELLE F. PARKER
Acting Commissioner of Patents and Trademarks